US008322986B2

(12) United States Patent
DeSander et al.

(10) Patent No.: US 8,322,986 B2
(45) Date of Patent: Dec. 4, 2012

(54) ROTOR BLADE AND METHOD OF FABRICATING THE SAME

(75) Inventors: Donald Brett DeSander, Cambridge, MA (US); James Earl Kopriva, Boston, MA (US); Robert Francis Manning, Newburyport, MA (US); Robert Edward Athans, Cincinnati, OH (US); Mark Douglas Gledhill, South Hamilton, MA (US)

(73) Assignee: General Electric Company, Schenectady, NY (US)

( * ) Notice: Subject to any disclaimer, the term of this patent is extended or adjusted under 35 U.S.C. 154(b) by 1034 days.

(21) Appl. No.: 12/181,740

(22) Filed: Jul. 29, 2008

(65) Prior Publication Data

US 2010/0024216 A1 Feb. 4, 2010

(51) Int. Cl.
*F01D 5/18* (2006.01)

(52) U.S. Cl. ..... 416/96 R; 416/97 R

(58) Field of Classification Search ..... 416/95, 416/96 R, 97 R, 232; 415/115, 116, 173.1, 415/175; 29/889.721
See application file for complete search history.

(56) References Cited

U.S. PATENT DOCUMENTS

| | | | | |
|---|---|---|---|---|
| 3,606,574 | A * | 9/1971 | Brands et al. | 416/96 R |
| 3,628,885 | A * | 12/1971 | Sidenstick et al. | 416/217 |
| 4,893,987 | A * | 1/1990 | Lee et al. | 416/92 |
| 5,785,496 | A | 7/1998 | Tomita | |
| 6,254,345 | B1 * | 7/2001 | Harris et al. | 416/96 R |
| 6,499,950 | B2 * | 12/2002 | Willett et al. | 416/97 R |
| 6,761,534 | B1 * | 7/2004 | Willett | 416/97 R |
| 6,790,005 | B2 * | 9/2004 | Lee et al. | 416/97 R |
| 7,568,882 | B2 * | 8/2009 | Brittingham et al. | 415/1 |
| 2001/0048878 | A1 * | 12/2001 | Willett et al. | 416/97 R |
| 2004/0126236 | A1 * | 7/2004 | Lee et al. | 416/97 R |
| 2007/0253815 | A1 * | 11/2007 | Kopmels et al. | 416/97 R |
| 2008/0170946 | A1 * | 7/2008 | Brittingham et al. | 416/97 R |

* cited by examiner

*Primary Examiner* — Richard Elms
*Assistant Examiner* — Harry W Byrne
(74) *Attorney, Agent, or Firm* — General Electric Company; David J. Clement; William Scott Andes

(57) ABSTRACT

A method of fabricating a rotor blade is provided. The method includes forming at least one passageway within the rotor blade, wherein the passageway extends substantially radially from a root of the rotor blade to a tip of the rotor blade, and coupling a shroud to the tip of the rotor blade. The shroud includes at least one substantially radially-outward extending wall that at least partially defines an outer plenum that is radially outward from at least the shroud, wherein the outer plenum is in flow communication with the passageway.

20 Claims, 8 Drawing Sheets

ROTOR BLADE AND METHOD OF FABRICATING THE SAME

BACKGROUND OF THE INVENTION

The field of this disclosure relates generally to a rotor blade and method of fabricating the same and, more particularly, to cooling a rotor blade.

At least some known rotor blades include tip shrouds to prevent leakage of gases past the tips of the rotor blades and to facilitate increasing operating efficiency. However, known tip shrouds may experience creep due to temperatures and loading during operation. By reducing the temperature of the shrouds during operation, the service life of the shroud may be extended. However, known tip shroud cooling features add weight to the extremities of the shroud and may increase the bending stresses in the shroud fillet and the blade airfoil. Further, although known tip shrouds generally increase aerodynamic efficiency, known tip shrouds may be limited by a mechanical gap that sets the leakage across seal teeth.

One known shroud cooling feature includes circumferential cavities cast within the rotor blade to cool the tip shroud. More specifically, the cavities are cast within the tip shroud using ceramic cores. However, such rotor blade fabrication results in a heavier blade due to casting constraints and in lower casting yields due to wall thickness variations and/or core breakage. Another known shroud cooling feature includes cooling holes drilled through the tip shroud. More specifically, the tip shroud cooling holes intersect holes drilled through the airfoil to provide the cooling air. However, such cooling holes require deep hole drilling technology and precise alignment and/or placement to ensure that the holes intersect. Moreover, high stress concentrations may exist at the intersection of the cooling holes regardless of alignment and over drills.

BRIEF DESCRIPTION OF THE INVENTION

In one embodiment, a method of fabricating a rotor blade is provided. The method includes forming at least one passageway within the rotor blade, wherein the passageway extends substantially radially from a root of the rotor blade to a tip of the rotor blade, and coupling a shroud to the tip of the rotor blade. The shroud includes at least one substantially radially-outward extending wall that at least partially defines an outer plenum that is radially outward from at least the shroud, wherein the outer plenum is in flow communication with the passageway.

In another embodiment, a rotor blade is provided. The rotor blade includes at least one passageway defined through the rotor blade. The passageway extends substantially radially from a root of the rotor blade to a tip of the rotor blade. The rotor blade also includes at least one wall extending substantially radially outward from the tip shroud, and an outer plenum that is radially outward from at least the tip shroud. The outer plenum is at least partially defined by the at least one wall, wherein the outer plenum is in flow communication with the passageway.

In yet another embodiment, a gas turbine engine is provided. The gas turbine engine includes a rotor extending at least partially through the gas turbine engine and at least one rotor blade coupled to the rotor. The rotor blade includes at least one passageway defined through the rotor blade. The passageway extends substantially radially from a root of the rotor blade to a tip of the rotor blade. The rotor blade also includes at least one wall extending substantially radially outward from the tip shroud, and an outer plenum that is radially outward from at least the tip shroud. The outer plenum is at least partially defined by the at least one wall, wherein the outer plenum is in flow communication with the passageway.

The embodiments described herein provide an apparatus and method for effectively cooling a rotor blade and/or tip shroud while reducing parasitic blade tip leakage.

DETAILED DESCRIPTION OF THE INVENTION

The embodiments described herein provide a tip-shrouded rotor blade that includes one or more radial passages that connect the root to the tip. The radially passage(s) are preferably cast within the rotor blade. Adjacent to, and radially inward from, the tip of the rotor blade, the radial passages connect to define an inner plenum. An outer plenum is defined by cast walls radially outward from the tip shroud. The outer plenum is enclosed by a cover plate coupled to the walls by, for example, welding or brazing, and the cover plate is physically secured in the radial direction using, for example, retention tabs. Alternatively, the outer plenum is enclosed by a weld and/or a braze. In the exemplary embodiment, holes are drilled into the outer plenum through the cover-plate, cast walls, seal teeth, and tip shroud outside of the airfoil-to-shroud load path. For example, the holes are positioned to avoid high stress regions of the rotor blade, such as a fillet between the shroud and the airfoil. Such holes are located and/or oriented to facilitate impingement and convective cooling. In addition, the holes exiting above the shroud gas path facilitate cooling and blockage to discourage tip leakage. More specifically, the holes exiting above the shroud gas path are oriented to produce swirling jets of air to facilitate increasing the blockage and decreasing parasitic tip leakage of the hot gas path flow.

Further, the embodiments described herein result in a tip-shrouded blade that facilitates balancing stresses, weights, and/or temperatures to meet predetermined operating conditions. The shroud temperature and effective tip clearance are both facilitated to be reduced by the embodiments described herein, resulting in a turbine efficiency improvement and improved tip blade durability.

Figure 1:
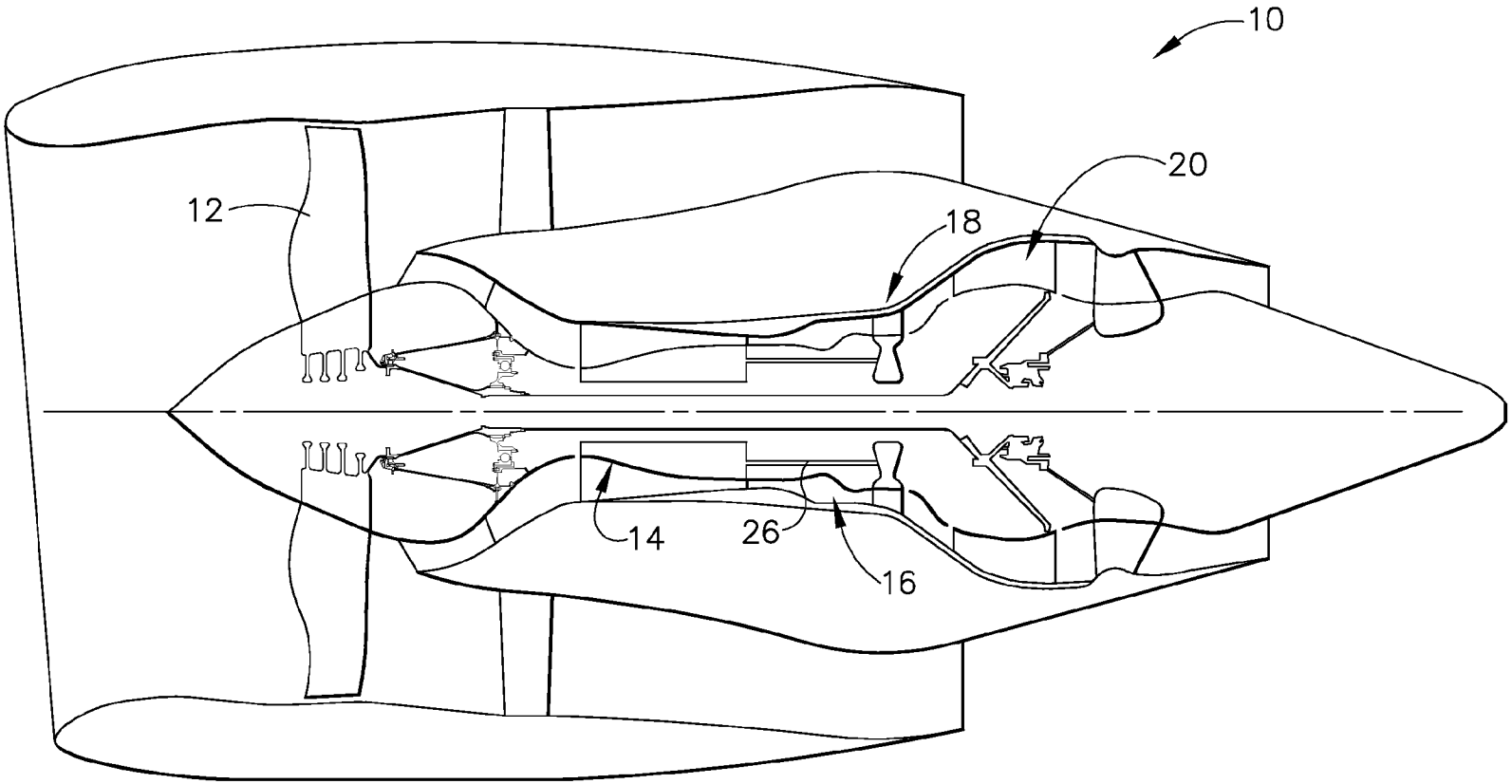
FIG. 1 is a schematic illustration of an exemplary gas turbine engine.

FIG. 1 is a schematic illustration of an exemplary gas turbine engine 10 that includes a low pressure compressor 12, a high pressure compressor 14, and a combustor 16. Engine 10 also includes a high pressure turbine 18 and a low pressure turbine 20. Compressor 12 and turbine 20 are coupled by a first rotor shaft 24, and compressor 14 and turbine 18 are coupled by a second rotor shaft 26. In operation, air flows through low pressure compressor 12 and compressed air is supplied from low pressure compressor 12 to high pressure compressor 14. Compressed air is then delivered to combustor 16 and airflow from combustor 16 drives turbines 18 and 20.

Figure 2:
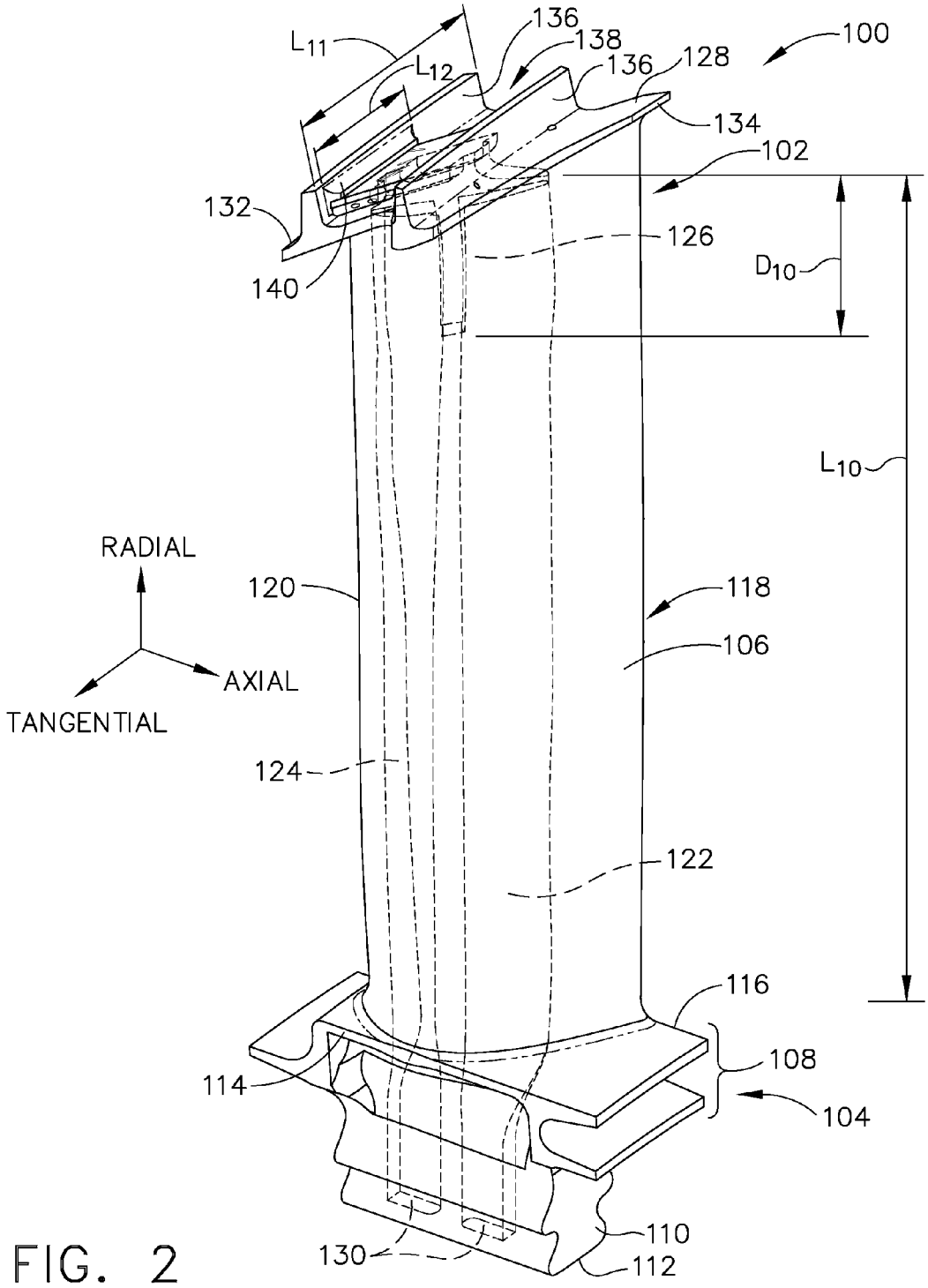
FIG. 2 is a side perspective view of an exemplary rotor blade that may be used with the gas turbine engine shown in FIG. 1.
Figure 3:
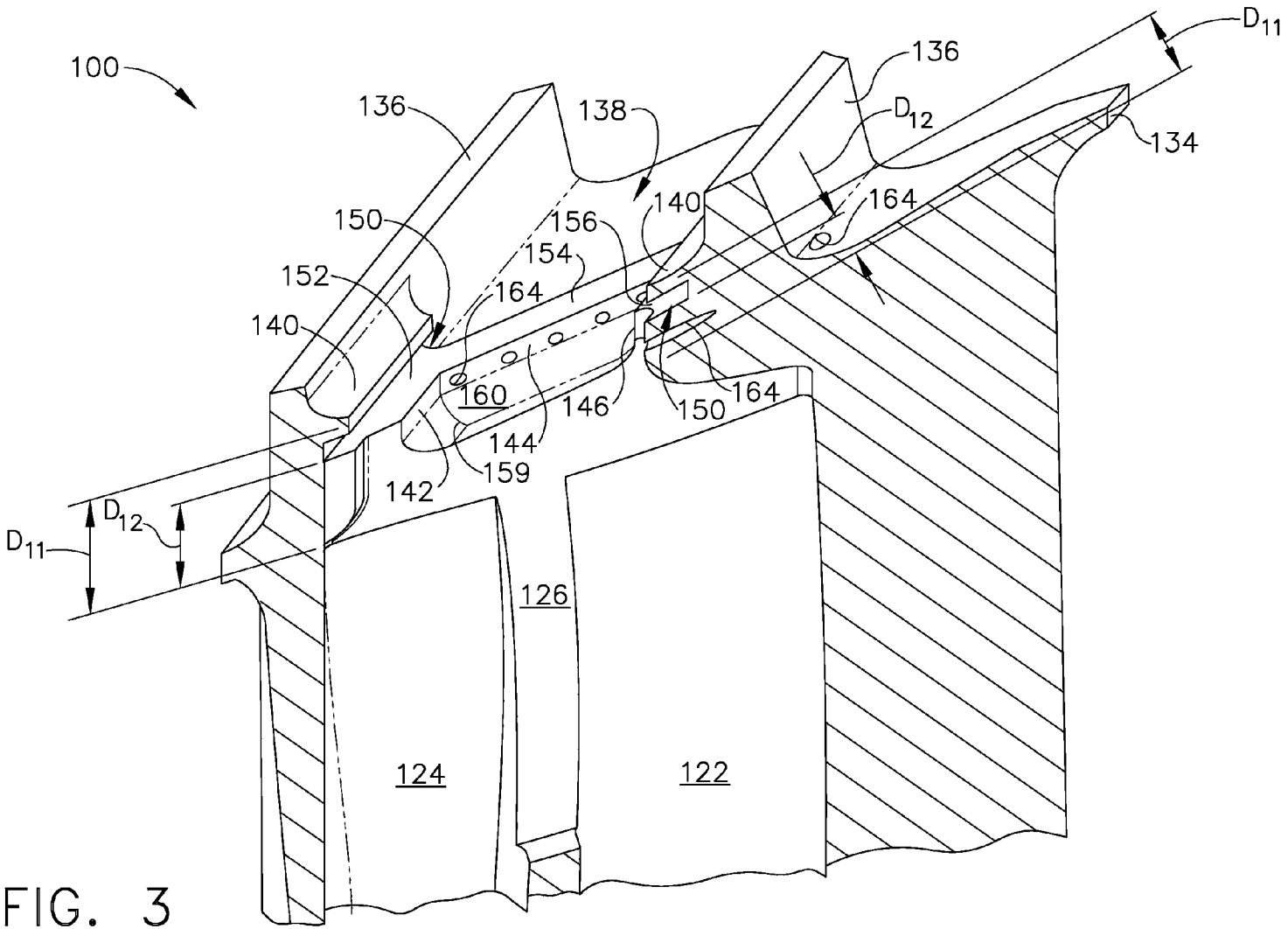
FIG. 3 is a cross-sectional view of a tip portion of the rotor blade shown in FIG. 2.

FIG. 2 is a side perspective view of an exemplary rotor blade 100 that may be used within gas turbine engine 10 (shown in FIG. 1). FIG. 3 is a cross-sectional view of a tip portion of rotor blade 100. In the exemplary embodiment, rotor blade 100 is coupled within turbine 18 and/or 20 (shown in FIG. 1) of engine 10. More specifically, in the exemplary embodiment, rotor blade 100 is coupled within the first stage of low pressure turbine 20. Alternatively, rotor blade 100 is coupled within turbine 18 and/or 20 at any suitable location. Further, rotor blade 100 may be coupled within any suitable rotary machine.

In the exemplary embodiment, rotor blade 100 includes a root 104, a tip 102, and an airfoil 106 extending between root 104 and tip 102. Root 104 includes a platform 108 and a base 110 that extends radially outward from a lower surface 112 of rotor blade 100 to platform 108. As used herein, the term "radially inward" refers to a direction from tip 102 towards root 104 and/or to an axis of rotation of the rotor to which blade 100 is coupled. The term "radially outward" refers to a direction towards tip 102 and/or a casing surrounding the rotor and blade 100 from the rotor to which blade 100 is coupled to. Platform 108 includes a pressure side edge 116 and a suction side edge 114. Platform 108 and/or base 110 may have any suitable shape that enables blade 100 to function as described herein. Moreover, in the exemplary embodiment, airfoil 106 includes a suction side 120 and a pressure side 118, which may each be formed in any suitable shape that enables blade 100 to function as described herein.

Figure 8:
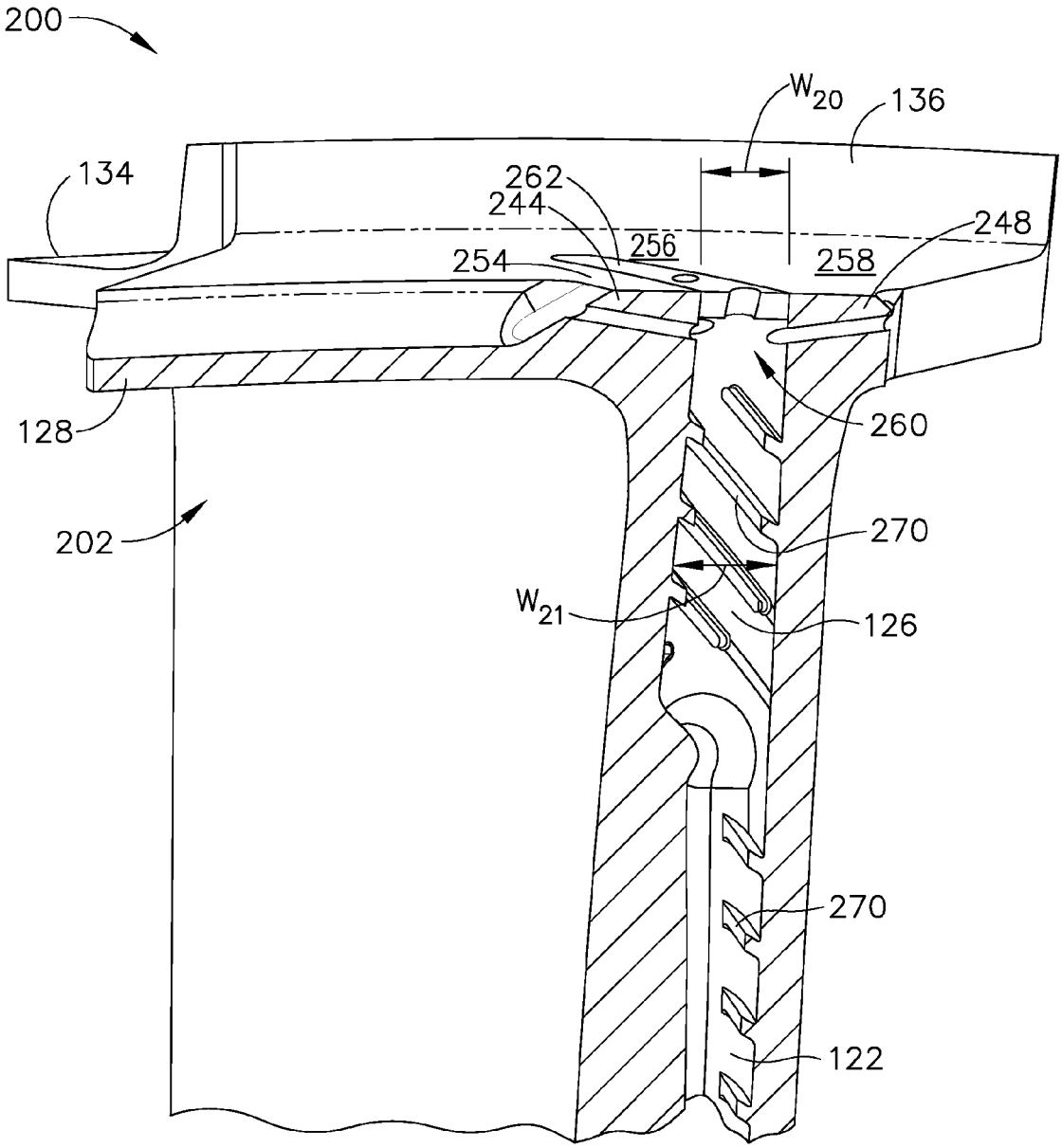
FIG. 8 is a cross-sectional view of a tip portion of the rotor blade shown in FIG. 7.

A first passageway 122 and a second passageway 124 are defined within and extend through airfoil 106 from root 104 to tip 102. Passageways 122 and 124 defined separately and remain separated throughout a majority of airfoil 106, but may be coupled together in flow communication at a distance $D_{10}$ radially inward from tip 102. More specifically, in the exemplary embodiment, passageways 122 and 124 are separate for between about 70% to about 90% of a radial length $L_{10}$ of airfoil 106, and are coupled together for between about 10% and about 30% of the radial length $L_{10}$. When combined, passageways 122 and 124 cooperate to define an inner plenum 126 that is radially inward from tip 102 and/or a tip shroud 128. Further, each passageway 122 and 124 includes an opening 130 that is defined within lower surface 112. Openings 130 enable air to enter each passageway 122 and 124 to facilitate cooling of rotor blade 100, as described herein. Although passageways 122 and 124 are shown without turbulators (not shown in FIG. 2 or 3), either passageway 122 and/or 124 may include at least one turbulator therein, as shown in FIG. 8.

Tip shroud 128 extends from tip 102. Tip 102 is radially inward from, and/or at approximately the same radial distance as, tip shroud 128. Tip shroud 128 may be formed integrally with blade 100 or may be coupled to blade 100. As used herein, the term "integrally" refers to the component being one-piece and/or being formed as a one-piece component. In the exemplary embodiment, tip shroud 128 includes a leading edge 132 and a trailing edge 134. Leading edge 132 and trailing edge 134 extend outward from airfoil 106 and/or tip 102 such that, in the exemplary embodiment, shroud 128 is oriented generally perpendicularly to airfoil sides 118 and 120. Shroud 128 interfaces and/or interconnects with shrouds extending from circumferentially-adjacent rotor blades 100. As such, the plurality of circumferentially-adjacent shrouds 128 form an assembly that extends circumferentially about, and at a radial distance from, a rotor to which the rotor blades 100 are coupled. The shroud assembly facilitates improving aerodynamic efficiency and decreasing vibrations of blades 100 during gas turbine engine 10 operation. Accordingly, shroud 128 may have any suitable shape, dimensions, and/or configuration that enables rotor blades 100 and/or gas turbine engine 10 to function as described herein.

A pair of seal teeth 136 extend radially outward from tip 102 and/or tip shroud 128. Each seal tooth 136 may be coupled to, and/or formed integrally with, tip 102 and/or tip shroud 128. Each seal tooth 136 extends circumferentially about a blade assembly (not shown) when a plurality of blades 100 are assembled about a rotor. As such, each seal tooth 136 is oriented generally radially and substantially perpendicular to the radial directions of blade 100. A channel 138 is defined between seal teeth 136 and extends substantially parallel to seal teeth 136. Within channel 138, a retention tab 140 extends axially from each seal tooth 136. As used herein, the term "axially" refers to a direction that is substantially parallel to a center of an axis of the engine such that the axial direction is substantially aligned with an axis of rotation a rotor to which rotor blade 100 is coupled. Retention tabs 140 are each spaced a distance $D_{11}$ radially outward from tip 102 and/or tip shroud 128. Alternatively, each retention tab 140 may be positioned at a different radial distance from tip 102 and/or tip shroud 128. In the exemplary embodiment, each retention tab 140 may be coupled to, and/or may be formed integrally with, a respective seal tooth 136. Further, retention tabs 140 are formed at a discrete location with respect to a length $L_{11}$ of seal teeth 136 such that a length $L_{12}$ of each retention tab 140 is shorter than seal tooth length $L_{11}$. Alternatively, retention tab(s) 140 may extend substantially along the full length $L_{11}$ of seal teeth 136 such that length $L_{12}$ is substantially equal to length $L_{11}$.

Figure 6:
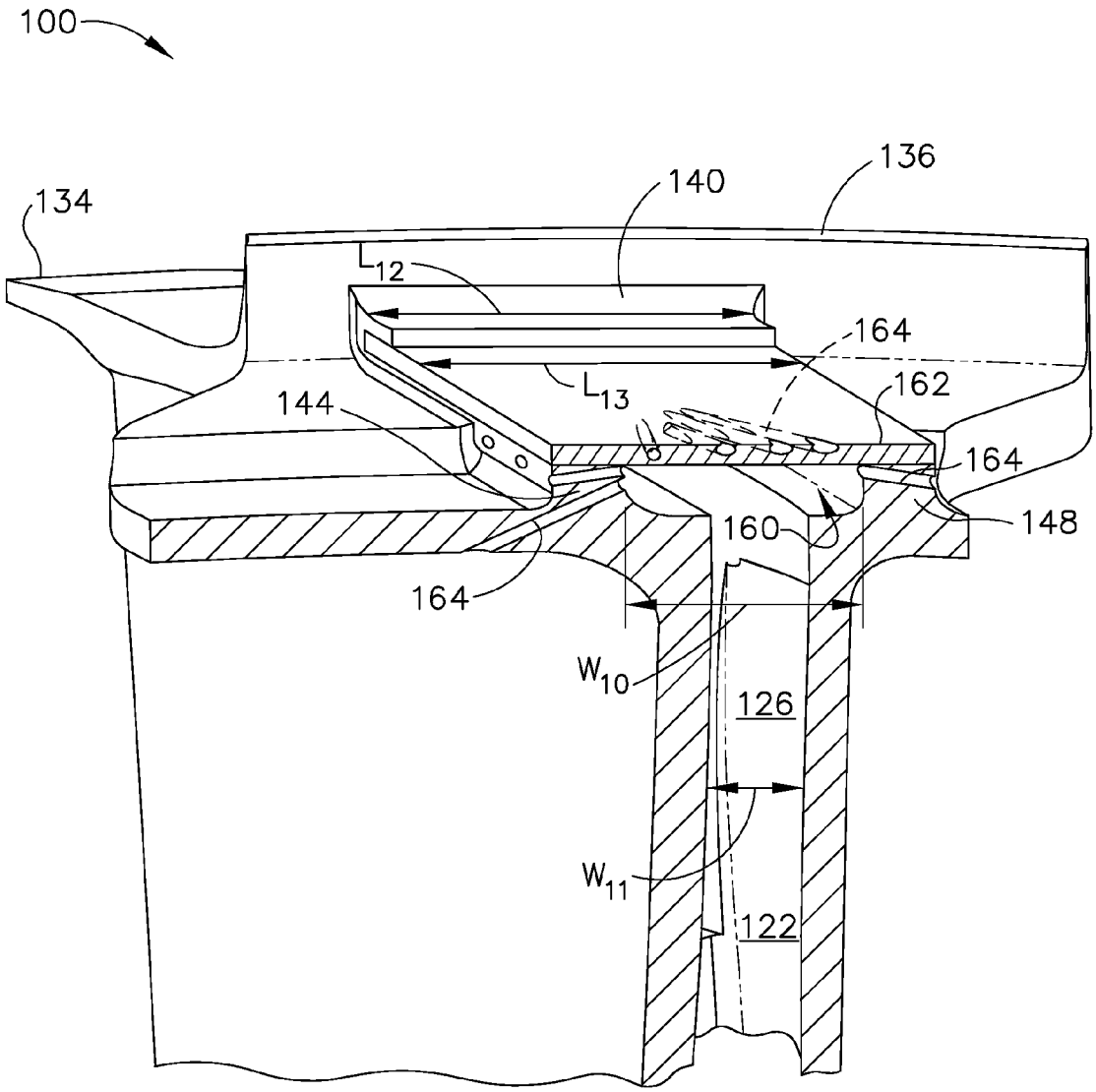
FIG. 6 is a side view of the rotor blade shown in FIG. 5 including cooling holes.
Figure 7:
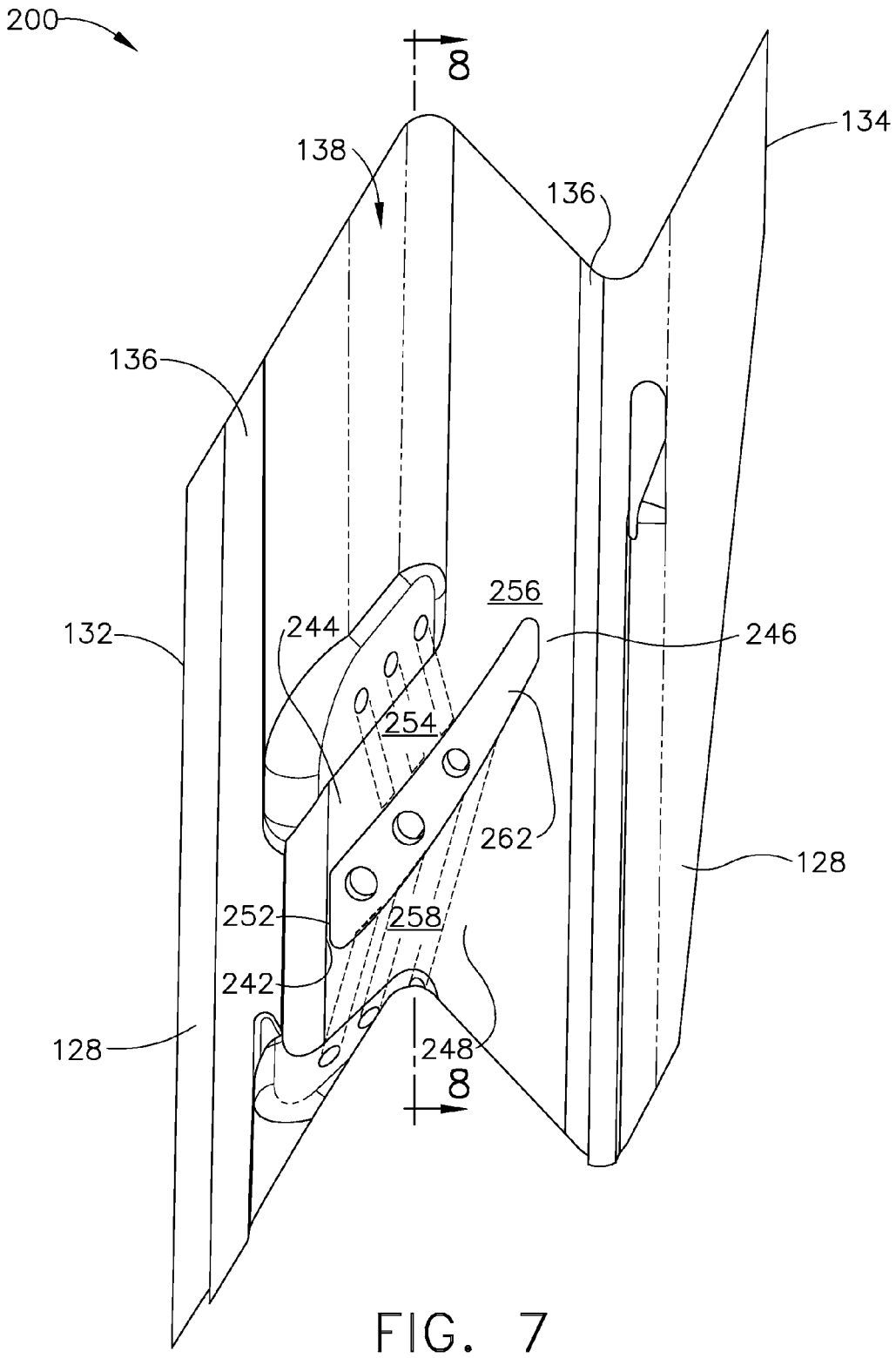
FIG. 7 is a top view of an alternative rotor blade that may be used with the gas turbine engine shown in FIG. 1.

In the exemplary embodiment, plenum walls 142, 144, 146, and 148 (shown in FIG. 4) each extend radially outward a distance $D_{12}$ from tip 102 and tip shroud 128 into channel 138. Alternatively, rotor blade 100 may include more or less than four walls 142, 144, 146, and/or 148. Further, although walls 142, 144, 146, and 148 are shown as being in the shape of a parallelogram, walls 142, 144, 146, and/or 148 may define any shape of any size that enables rotor blade 100 to function as described herein. In the exemplary embodiment, plenum walls 142 and 146 each extend generally axially from each seal tooth 136 and towards an opposing plenum wall 146 or 142. A gap 150 is defined between a radially outward surface or outer surfaces 152 and 156 of each respective plenum wall 142 and 146 and an adjacent retention tab 140. Plenum walls 144 and 148 extend between opposing seal teeth 136 and are coupled to ends 159 of plenum walls 142 and 146. Outer surfaces 154 and 158 of respective plenum walls 144 and 148 are substantially co-planar with radially outward surfaces 152 and 156. Plenum walls 142, 144, 146, and 148 define a radially outward plenum or outer plenum 160 that is radially outward from tip 102, tip shroud 128, and inner plenum 126. Outer surfaces 152, 154, 156, and 158 define an outer surface of outer plenum 160. Outer plenum 160 is in flow communication with inner plenum 126. In the exemplary embodiment, outer plenum 160 is wider than inner plenum 126, as shown in FIG. 6. Alternatively, as shown in FIGS. 7 and 8, outer plenum 160 may have a width $W_{10}$ that is approximately equal to or narrower than a width $W_{11}$ of inner plenum 126. In the exemplary embodiment, inner plenum 126 and/or outer plenum 160 have any size and/or configuration that facilitates cooling of rotor blade 100.

Figure 4:
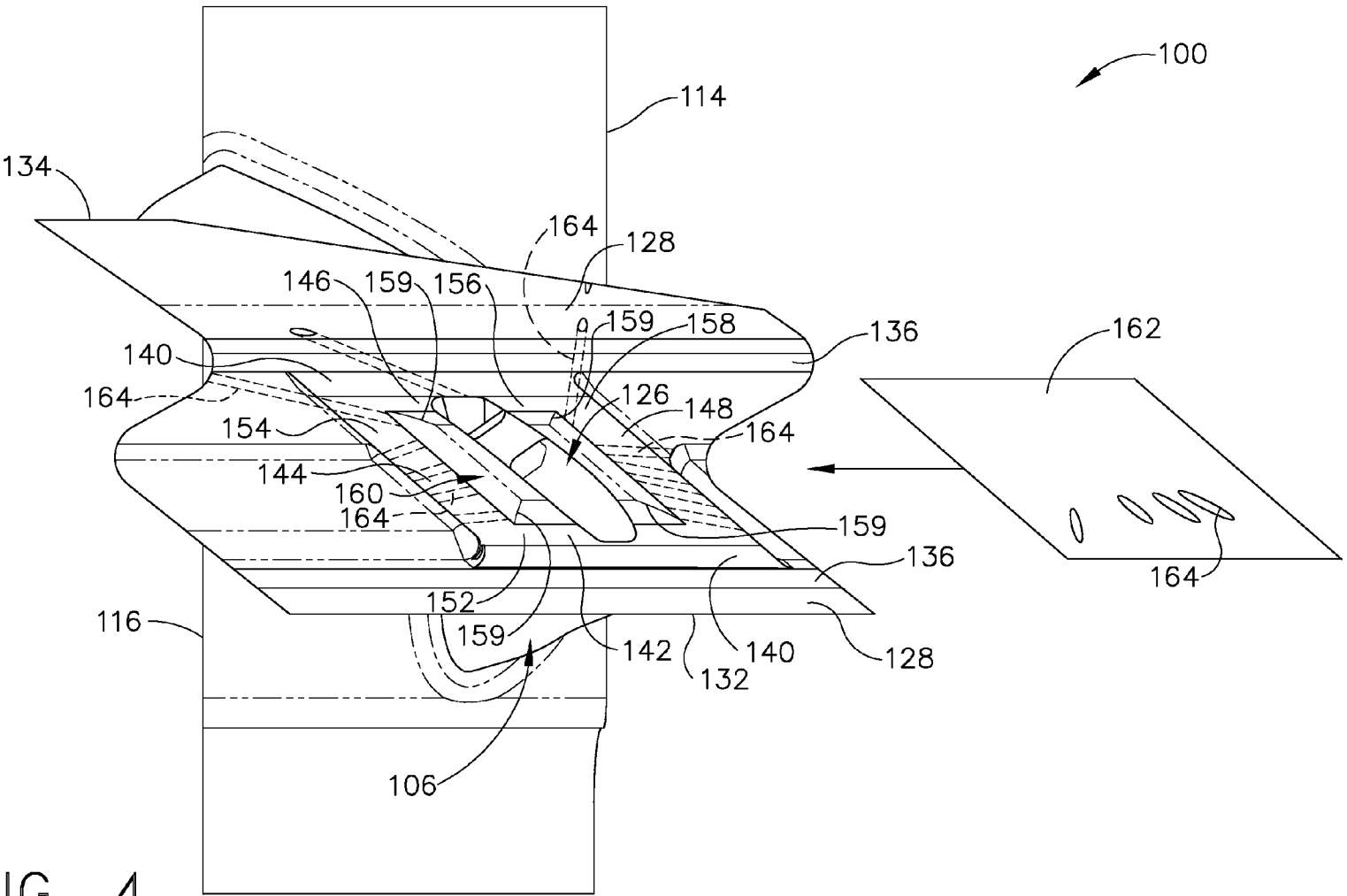
FIG. 4 is a top view of the rotor blade shown in FIG. 2.
Figure 5:
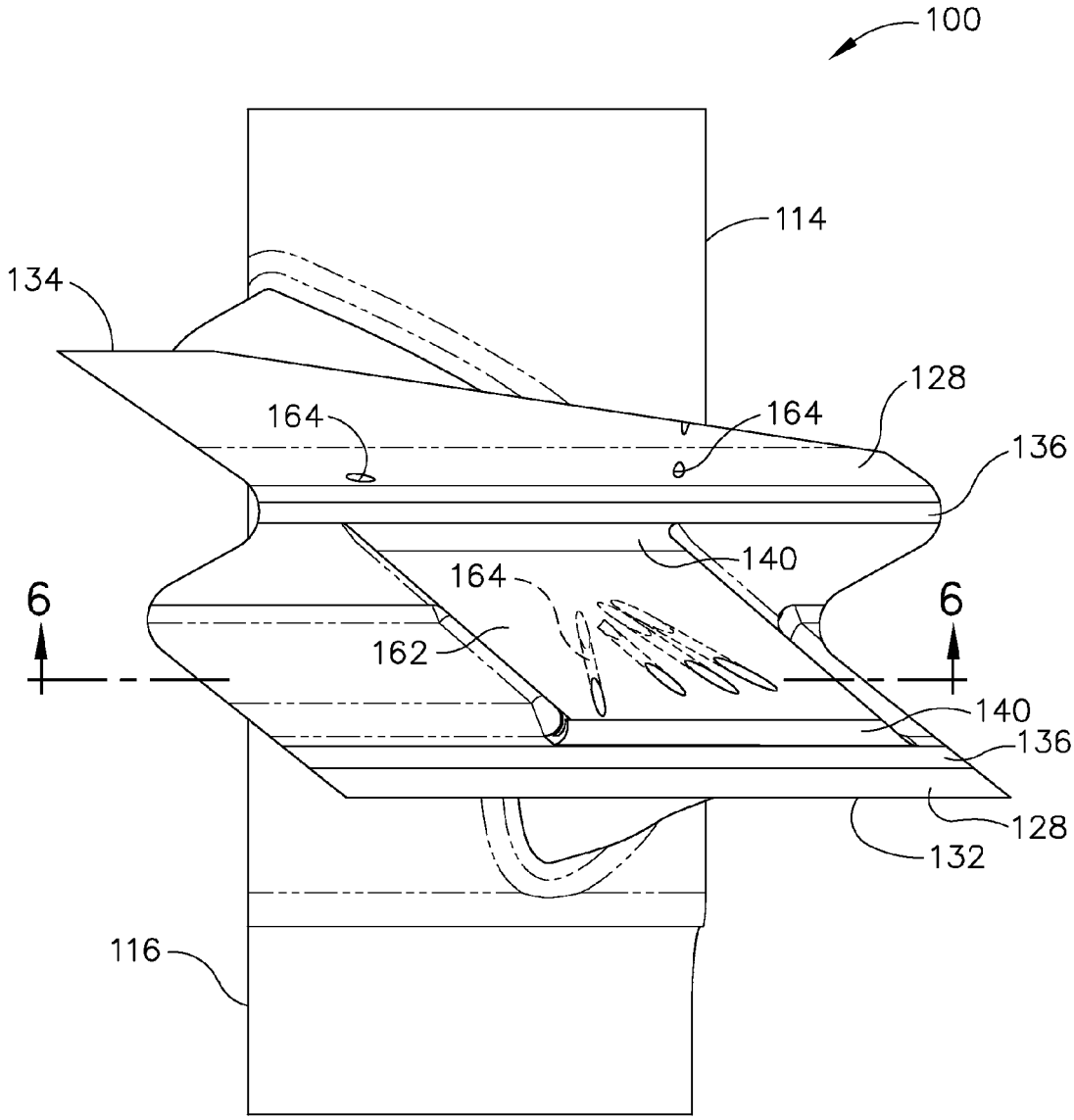
FIG. 5 is a top view of the rotor blade shown in FIG. 2 with a closure plate coupled thereto.

FIG. 4 is a top view of rotor blade 100. FIG. 5 is a top view of rotor blade 100 with a cover plate 162 coupled thereto. FIG. 6 is a side view of rotor blade 100 including cooling holes 164. In the exemplary embodiment, cover plate 162 is coupled to outer plenum 160. More specifically, cover plate 162 and plenum walls 142, 144, 146, and 148 have substantially the same shape and/or size such that cover plate 162 may be coupled to outer surfaces 152, 154, 156, and 158 of walls 142, 144, 146, and 148, respectively, to substantially enclose outer plenum 160. Alternatively, cover plate 162 is sized and shaped to be inserted within walls 142, 144, 146, and 148 to substantially enclose outer plenum 160. In the exemplary embodiment, cover plate 162 is secured to walls 142, 144, 146, and 148 by retention tabs 140. More specifically, cover plate 162 is sized to be inserted into gaps 150, and length $L_{12}$ of retention tabs 140 is substantially equal to a cover plate length $L_{13}$.

In the exemplary embodiment, at least one cooling hole 164 extends through at least one of tip 102, tip shroud 128, cover plate 162, walls 142, 144, 146, and/or 148, and/or a seal tooth 136 into outer plenum 160. Cooling holes 164 are located/or oriented to discharge impingement air on seal teeth 136 and to discourage gas leakage across seal teeth 136. Further, cooling holes 164 are located and/or oriented to facilitate cooling tip shroud 128, tip 102, seal teeth 136 and/or any other suitable components of rotor blade 100 and/or gas turbine engine 10. Moreover, rotor blade 100 may include any suitable number of cooling holes 164 that enables rotor blade 100 to function as described herein.

Referring to FIGS. 2-6, rotor blade 100 is fabricated with passageways 122 and 124 therein. More specifically, in the exemplary embodiment, root 104, airfoil 106, tip 102, tip shroud 128, seal teeth 136, retention tabs 140, walls 142, 144, 146, and 148, and passageways 122 and 124 are cast together as one-piece. Alternatively, any of the above-listed components of rotor blade 100 may be formed in a separate fabrication process and coupled to rotor blade 100 using, for example, welding, brazing, and/or any other suitable coupling mechanism and/or technique that enables rotor blade 100 to function as described herein. In the exemplary embodiment, cover plate 162 is fabricated with a shape that substantially corresponds to that of outer plenum 160 as defined by cast walls 142, 144, 146, and 148.

Cooling holes 164 are defined within cover plate 162 by, for example, drilling, prior to cover plate 162 being coupled to rotor blade 100 to facilitate achieving predetermined hole angles. Alternatively or additionally, cooling holes 164 are formed in cover plate 162 after cover plate 162 is coupled to rotor blade 100. In the exemplary embodiment, cover plate 162 is slidably coupled circumferentially in gap 150 such that cover plate 162 is positioned between retention tabs 140 and walls 142, 144, 146, and 148. More specifically, cover plate 162 is inserted under retention tabs 140 such that walls 142, 144, 146, and 148 are substantially covered by cover plate 162 and such that outer plenum 160 is substantially enclosed by cover plate 162.

Cover plate 162 is coupled to rotor blade 100 by, for example, brazing and/or welding. Cooling holes 164 are defined within outer plenum 160 in various locations, such as, tip 102, tip shroud 128, seal teeth 136, and/or walls 142, 144, 146, and/or 148, as shown in FIGS. 4-6. Locations and/or orientations of cooling holes 164 are determined based on a configuration of gas turbine engine 10, rotor blade 100, and/or based on predetermined operating conditions for gas turbine engine 10 and/or rotor blade 100.

During operation of gas turbine engine 10, air is channeled through rotor blade 100 to tip 102, tip shroud 128, seal teeth 136, and/or any suitable component within gas turbine engine 10. More specifically, air is channeled into passageways 122 and 124 through openings 130. Air from passageways 122 and 124 is channeled into inner plenum 126 and is discharged into outer plenum 160. Air in outer plenum 160 is discharged through cooling holes 164 to facilitate cooling components of rotor blade 100, such as tip shroud 128, and to facilitate decreasing leakage past seal teeth 136.

FIG. 7 is a top view of an alternative exemplary rotor blade 200 that may be used with gas turbine engine 10 (shown in FIG. 1). FIG. 8 is a cross-sectional view of a tip 202 of rotor blade 200. Rotor blade 200 is substantially similar to rotor blade 100, as described above, with the exception that rotor blade 200 includes a cover plate 262 that is a weld and/or a braze sized to join walls 242, 244, 246, and 248. Alternatively, cover plate 262 is any size, type, and/or configuration of material that is suitable for enclosing outer plenum 260. In the exemplary embodiment, walls 242, 244, 246, and 248 of rotor blade 200 are shaped and configured differently from walls 142, 144, 146, and 148 of rotor blade 100. Because rotor blade 200 is substantially similar to rotor blade 100, like components are referred to with the same reference number.

Passageways 122 and 124 include turbulators 270 therein. Further, inner plenum 126 includes turbulators 270 therein. Turbulators 270 are configured to create turbulence within air flows through passageways 126 and/or 128 and inner plenum 126 to facilitate increasing the heat transfer coefficient of the air flows. In an alternative embodiment, passageways 122 and/or 124 and/or inner plenum 126 do not include turbulators 270.

In the exemplary embodiment, walls 242, 244, 246, and 248 define an outer plenum 260 that has a width $W_{20}$ that is substantially equal to a width $W_{21}$ of inner plenum 126. Alternatively, width $W_{20}$ of outer plenum 260 is narrower than, or wider than, to width $W_{21}$ of inner plenum 126. In the exemplary embodiment, walls 242, 244, 246, and 248 are oriented to define an irregularly-shaped outer plenum 260, as opposed to parallelogram-shaped outer plenum 160 (shown in FIGS. 2-6). The shape of walls 242, 244, 246, and/or 248, and accordingly, outer plenum 260, is based on predetermined operating conditions of gas turbine engine 10 and/or predetermined operating conditions rotor blade 200. In the exemplary embodiment, outer surfaces 252, 254, 256, and 258 define an outer surface of outer plenum 260.

Cover plate 262, also referred to herein as a weld and/or a braze, is sized to be received within walls 242, 244, 246, and 248 to substantially enclose outer plenum 260. As such, rotor blade 200 does not includes retention tabs. To fabricate rotor blade 200, the above-described method is performed with the exception that weld 262 is inserted within walls 242, 244, 246, and 248 to substantially enclose outer plenum 260, as opposed to being slidably inserted between walls 242, 244, 246, and 248 and retention tabs. In the exemplary embodiment, weld 262 is coupled to walls 242, 244, 246, and 248 using, for example, welding and/or brazing. When weld 262 is coupled to walls 242, 244, 246, and/or 248 and/or outer plenum 262, an outer surface of weld 262 is substantially co-planar with wall outer surfaces 252, 254, 256, and/or 258.

The above-described rotor blades and fabrication methods provide a rotor blade that includes features to facilitate cooling the rotor blade and reducing tip leakage. More specifically, cooling holes are located and/or oriented to facilitate impingement and convective cooling of the rotor blade and/or gas turbine engine components that are adjacent to the rotor blade. The above-described cooling holes are located and/or oriented in the outer plenum to avoid creating a high stress concentration at, for example, the airfoil-to-fillet shroud. Further, the cooling holes defined in the cover plate and/or above a shroud gas path facilitate cooling and blockage to discourage tip leakage. More specifically, the holes exiting above the shroud gas path are oriented to produce swirling jets of air to facilitate increasing the blockage and decreasing parasitic tip leakage of the hot gas path flow. Moreover, the above-described rotor blades and fabrication methods provide a tip-shrouded blade that facilitates balancing stresses, weights, and/or temperatures to meet predetermined operating conditions. The shroud temperature and effective tip clearance are both reduced by the embodiments described herein, resulting in a turbine efficiency improvement and improved tip blade durability.

Exemplary embodiments of a rotor blade and methods of fabricating the same are described above in detail. The apparatus and methods are not limited to the specific embodiments described herein, but rather, components of apparatus and/or steps of the methods may be utilized independently and separately from other components and/or steps described herein. For example, the methods may also be used in combination with other rotor blades and fabrication methods, and are not limited to practice with only the tip-shrouded rotor blade and fabrication methods as described herein. Rather, the exemplary embodiment can be implemented and utilized in connection with many other fabrication applications. Further, the features of the rotor may also be used in combination with other rotor blades and fabrication methods, and are not limited to practice with only the tip-shrouded rotor blade and fabrication methods as described herein. Rather, the exemplary embodiment can be implemented and utilized in connection with many other rotor blade cooling applications.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A method of fabricating a rotor blade, said method comprising:

forming at least one passageway within the rotor blade, wherein the at least one passageway extends substantially radially from a root of the rotor blade to a tip of the rotor blade; and coupling a shroud to the tip of the rotor blade, wherein the shroud includes at least one substantially radially-outward extending wall that at least partially defines an outer plenum positioned radially outward from at least the shroud such that the outer plenum is positioned above the shroud when the root of the rotor blade is at a bottom of the rotor blade, wherein the outer plenum is in flow communication with the at least one passageway.

2. A method in accordance with claim 1 further comprising coupling a cover plate to an outer surface of the outer plenum.

3. A method in accordance with claim 2 further comprising forming at least one hole extending through the cover plate into the outer plenum to facilitate cooling the rotor blade.

4. A method in accordance with claim 2 wherein coupling a cover plate to an outer surface of the outer plenum further comprises:

forming at least two retention tabs radially outward from the outer surface of the outer plenum; and inserting the cover plate between the outer surface of the outer plenum and the at least two retention tabs.

5. A method in accordance with claim 1 further comprising forming at least one hole within the tip shroud that extends into the outer plenum to facilitate cooling the rotor blade.

6. A method in accordance with claim 1 further comprising forming at least one seal tooth that extends radially outward from the shroud.

7. A method in accordance with claim 1 further comprising coupling a cover plate to the outer plenum such that an outer surface of the cover plate is substantially co-planar with an outer surface of the at least one wall, wherein the cover plate is at least one of a weld and a braze.

8. A rotor blade comprising:

at least one passageway defined therethrough, said at least one passageway extending substantially radially from a root of said rotor blade to a tip of said rotor blade;

a tip shroud extending from said tip;

at least one wall extending substantially radially outward from said tip shroud; and an outer plenum positioned radially outward from at least said tip shroud such that said outer plenum is positioned above said tip shroud when said root of said rotor blade is at a bottom of said rotor blade, said outer plenum at least partially defined by said at least one wall, wherein said outer plenum is in flow communication with said at least one passageway.

9. A rotor blade in accordance with claim 8 further comprising a cover plate coupled to an outer surface of said outer plenum.

10. A rotor blade in accordance with claim 9 further comprising at least one hole extending through said cover plate extending into said outer plenum to facilitate cooling said rotor blade.

11. A rotor blade in accordance with claim 9 further comprising at least two retention tabs that are radially outward from said outer surface of said outer plenum, wherein said cover plate is coupled between said outer surface of said outer plenum and said at least two retention tabs.

12. A rotor blade in accordance with claim 8 further comprising at least one hole within said tip shroud that extends into said outer plenum to facilitate cooling said rotor blade.

13. A rotor blade in accordance with claim 8 further comprising a pair of seal teeth that extend radially outward from said tip shroud, said pair of seal teeth defining a channel therebetween, said outer plenum defined within said channel.

14. A rotor blade in accordance with claim 8 further comprising a cover plate coupled to said outer plenum such that an outer surface of said cover plate is substantially co-planar with an outer surface of said outer plenum, wherein said cover plate comprises at least one of a weld and a braze.

15. A rotor blade in accordance with claim 8 wherein said at least one passageway comprises a first passageway and a second passageway, said first passageway and said second passageway defining an inner plenum that is radially inward from said tip shroud, said inner plenum in flow communication with said outer plenum.

16. A gas turbine engine comprising:

a rotor extending at least partially through said gas turbine engine; and at least one rotor blade coupled to said rotor, said rotor blade comprising:

at least one passageway defined through said rotor blade, said at least one passageway extending substantially radially from a root of said rotor blade to a tip of said rotor blade;

at least one wall extending substantially radially outward from said tip shroud; and an outer plenum positioned radially outward from at least said tip shroud such that said outer plenum is positioned above said tip shroud when said root of said rotor blade is at a bottom of said rotor blade, said outer plenum at least partially defined by said at least one wall, wherein said outer plenum is in flow communication with said at least one passageway.

17. A gas turbine engine in accordance with claim 16 wherein said rotor blade further comprises a cover plate coupled to said outer plenum, said cover plate comprising at least one hole extending therethrough to said outer plenum, said at least one hole configured to facilitate cooling said rotor blade.

18. A gas turbine engine in accordance with claim 16 wherein said rotor blade further comprises at least two seal teeth that extend radially outward from said tip shroud, said at least two seal teeth defining a channel therebetween, said outer plenum defined within said channel.

19. A gas turbine engine in accordance with claim 17 wherein said rotor blade further comprises at least two retention tabs that are radially outward from an outer surface of said outer plenum, wherein said cover plate is coupled between said outer surface of said outer plenum and said at least two retention tabs.

20. A gas turbine engine in accordance with claim 16 wherein said rotor blade further comprises a first passageway and a second passageway, said first passageway and said second passageway defining an inner plenum that is radially inward from said tip shroud, said inner plenum in flow communication with said outer plenum.

* * * * *